United States Patent [19]

Dechantsreiter

[11] 4,316,528

[45] Feb. 23, 1982

[54] MECHANISM FOR LATCHINGLY CONNECTING TELESCOPING MEMBERS

[75] Inventor: Max J. Dechantsreiter, Milwaukee, Wis.

[73] Assignee: Harnischfeger Corporation, West Milwaukee, Wis.

[21] Appl. No.: 129,196

[22] Filed: Mar. 11, 1980

[51] Int. Cl.[3] ..... B66C 19/00

[52] U.S. Cl. ..... 187/9 E; 212/124; 212/213; 212/DIG. 1; 414/281

[58] Field of Search ..... 187/9 R, 9 E; 212/124, 212/11, 213; 414/281

[56] References Cited

U.S. PATENT DOCUMENTS

| | | | |
|---|---|---|---|
| 2,502,465 | 4/1950 | Lehmann | 187/9 E |
| 2,906,373 | 9/1959 | Hastings, Jr. et al. | 187/9 E |
| 3,051,265 | 8/1962 | Boyajian et al. | 187/9 E |
| 3,064,761 | 11/1962 | Ramsey | 187/9 E |
| 3,144,137 | 8/1964 | Valliere et al. | 212/128 |
| 3,187,842 | 6/1965 | Quayle | 187/9 E |
| 3,250,182 | 5/1966 | Nansel | 212/268 |
| 3,269,561 | 8/1966 | De Ligt | 187/9 E |
| 3,791,529 | 2/1974 | Thomas | 212/124 |

*Primary Examiner*—Lawrence J. Oresky
*Attorney, Agent, or Firm*—James E. Nilles

[57] ABSTRACT

A stacker crane having an elevated trolley on which there is a hoist, a load member beneath the trolley is moved vertically by the hoist and is guided by a mast comprising a vertically fixed inner member projecting down from the trolley and an intermediate member telescopingly slidable on the inner member. In one locking position of a toggle element swingably carried by the intermediate member it engages an upwardly facing surface of a ledge on the load member, constraining the intermediate member to move with the load member in a lower part of the range of vertical motion of the load member; in the upper part of that range the toggle element, in an opposite locking position, engages an upwardly facing surface on a ledge on the inner member so that the latter supports the intermediate member. The position of the toggle element is controlled by a pair of latching elements carried by the intermediate member at opposite sides of the toggle element, each movable up and down relative to the intermediate member and biased up to a latching position holding the toggle element in one locking position; but each latching element can move to its latching position only when the other is out of that position. The latching elements are displaced out of their respective latching positions by a dog on each, each dog engageable with a downwardly facing surface on one of the ledges.

11 Claims, 9 Drawing Figures

MECHANISM FOR LATCHINGLY CONNECTING TELESCOPING MEMBERS

FIELD OF THE INVENTION

This invention relates to a latching mechanism whereby an intermediate one of three telescopingly slidable members—such as the mast members of a stacker crane—is alternatively connectable with either the first or the third of those members to be constrained against sliding motion relative to the member with which it is connected; and the invention is more particularly concerned with an improved automatic latching mechanism of that type, having relatively few and simple parts and wherein camming and wedging relationships are avoided as between parts that have motion transmitting engagements with one another.

BACKGROUND OF THE INVENTION

U.S. Pat. No. 3,269,561, to J. DeLigt, discloses a latching mechanism of the general type to which the present invention relates and exemplifies some of the problems that are solved by the invention and the disadvantages that are avoided or overcome by it. As brought out in the DeLigt patent, a typical application for such a mechanism is in a stacker crane used for placing articles onto and removing them from vertically spaced storage shelves or the like. A stacker crane comprises a bridge-like trolley which runs along laterally spaced overhead tracks and from which a rigid, relatively fixed inner mast member projects downward. An intermediate mast member is slidable up and down in telescoping relation to the inner mast member, for effectively increasing its downward extension. A load carrying member, which can comprise a horizontally projecting fork, is guided for up and down motion on the intermediate mast member.

The latching mechanism operates in such a manner that the load carrying member, when in the lower part of its range of up and down motion, is effectively locked to the bottom portion of the intermediate mast member, which therefore moves up and down with the load carrying member and is guided on the inner mast member. In an upper portion of the range of motion of the load carrying member, the intermediate mast member is effectively locked to the inner mast member, and the load carrying member moves up and down realtive to both of those mast members. The latching mechanism thus enables the load carrying member to move through most of the distance between the trolley and the floor of the area traversed by the crane, while the mast never extends any farther down than is necessary to dispose the load carrying member at the level where it is needed, thus minimizing the chances for a collision between the crane and articles on the floor beneath it.

With the type of mechanism here under consideration, the intermediate mast member of a stacker crane is always supported either by the load carrying member or by the inner mast member, and therefore only the load carrying member has to have a direct connection with the hoisting drum or windlass. The latching mechanism changes the locking connection automatically as the load carrying member moves through a small zone intermediate the limits of its range of motion. As the load carrying member traverses that zone, the intermediate mast member can be transiently locked to both the load carrying member and the inner mast member, but there obviously cannot be an instant when the intermediate member is disconnected from both of those other members and is thus free to drop.

The automatic latching mechanism disclosed in the DeLigt patent comprised a toggle element that was carried by the intermediate mast member and was swingable relative to it between a pair of defined locking positions. In one locking position the toggle element engaged an abutment on the inner mast member; in the other it engaged an abutment on the load carrying member. Under the weight of the intermediate member, the toggle element tended to swing away from each of its locking positions, and therefore automatically operating means had to be provided for confining the toggle element in each locking position, for releasing it from such confinement when it was to flip over to its other locking position, and for again releasably confining it when it attained its other locking position. The means for effecting such confinement and release at the proper times comprised a slidable latching element that was carried by the intermediate mast member for movement relative to it between toggle latching and toggle releasing positions. The latching element was actuated by cams that were respectively fixed on the inner mast member and on the load carrying member, and those cams had to have substantial vertical extension to ensure that the latching element would always maintain its proper position through all movements of the telescoped members relative to one another. When the latching element was in its latching position, the toggle element engaged it under bias, and such bias had to be relieved before the latching element could be shifted to its releasing position. Hence there had to be a second set of cams, respectively carried by the inner mast member and the load carrying member, which cooperated with the toggle element for relieving its force against the latching element.

As is apparent from the foregoing brief description, the mechanism of the DeLigt patent was complicated, in that it comprised numerous parts, some of which were rather cumbersome and all of which had to be assembled in rather accurate relationships to one another. As a result, the mechanism tended to be more expensive than the conventional counterweight for the intermediate mast member—which it was intended to supplant—and it seems to have had no significant commercialization.

The DeLigt patent brings out that simplicity, compactness and low cost were among the objects sought to be achieved by means of the structure disclosed in it, and that structure was evidently the utmost in simplicity, compactness and low cost that the patentee was able to attain, notwithstanding the ingenuity and the high degree of skill in the art that the patent otherwise demonstrates.

SUMMARY OF THE INVENTION

The general object of the present invention is to provide automatically operating latching mechanism of the character described which is superior to that of the prior art with respect to simplicity, compactness and cost, wherein there are relatively few and simple parts that have no critical fit relationships to complicate manufacture, assembly or maintenance, and wherein motion is transmitted from one part to another through abutments that squarely oppose one another rather than through sliding engagement of camming elements.

For purposes of example, the invention is herein described and discussed in its application to a stacker crane, but it will be understood that the invention provides a simple, inexpensive, compact and sturdy automatic latching mechanism that is of utility in any apparatus comprising three members that are in generally telescoped relation to one another and wherein a first and a second of the three members are movable in a pair of opposite directions relative to one another and to the third member, but wherein said second member must be constrained to move with the first member when the latter is at one side of a medial zone in a range of its motion in said directions and must be confined against motion relative to the third member when the first member is at the other side of said zone.

Another and more specific object of the invention is to provide automatic latching mechanism for a system comprising first and second members which are movable in a pair of opposite directions relative to one another and to a third member, said latching mechanism comprising a toggle element carried by the second member (which corresponds to the intermediate mast of a stacker crane), and toggle control means likewise carried by the second member for movement relative to it, wherein abutments on the first and third members cooperate with dogs on the toggle control means to so control the position of the toggle element that it locks the second member to the first member or to the third member in accordance with the position of the first member relative to the third member.

It is also a specific object of this invention to provide automatic latching mechanism of the character described that comprises a toggle element which is carried by the second member for freely swingable motion relative to it between a pair of positions at which it respectively engages ledges on the first and on the third members, to provide for locking the second member alternatively to each of those other members, and wherein a pair of latching elements are slidably carried by the second member for movement relative thereto, each latching element being movable to and from a latching position in which it confines the toggle element in one of its said positions, said latching elements being arranged to cooperate with one another and the toggle element in the manner of an overcenter toggle that is tripped by the engagement of dogs on the latching elements against the respective ledges on the first and third members.

It is also a specific object of this invention to provide automatic latching mechanism of the character described comprising a toggle element which is carried by said second member for movement to each of a pair of alternative locking positions and which tends to swing out of each of those positions, and a pair of latching elements, also carried by said second member, whereby the position of said toggle element is controlled, each latching element being movable towards and from a latching position at which it confines the toggle element in one of its said locking positions, and each latching element being biased to its latching position but being movable thereto only when the other is out of its latching position.

The mechanism of this invention is suitable for any apparatus having first and second members which are movable in a pair of opposite directions relative to one another and to a third member, and wherein said first member has a range of motion in said directions that extends to opposite sides of a medial zone and said second member is biased in the direction towards one side of said zone. The mechanism of this invention comprises automatic connection means whereby said second member is constrained to move with said first member when the latter is at said one side of said zone and whereby said second member is confined against motion relative to said third member when the first member is at the other side of said zone. The mechanism is characterized by a toggle element carried by said second member and confined to swinging motion relative to it between a pair of locking positions; a pair of latching elements carried by said second member for limited motion relative to it in said directions and for cooperation with said toggle element, each latching element being biased in the other of said directions to a latching position in which it confines the toggle element in one of its locking positions and being movable against bias to a releasing position freeing the toggle element to swing to its other locking position, said toggle element permitting each latching element to move to its latching position only when the other is in its releasing position. The mechanism also comprises a pair of locking ledges, each defining an abutment facing substantially in said other of said directions, one of said ledges being fixed on said third member and being engaged by said toggle element when one of said latching elements is in its releasing position, and the other of said ledges being fixed on said first member and being engaged by said toggle element when the other of said latching elements is in its releasing position. There are cooperating displacement abutments on the third member and on said one latching element whereby the latter is displaced to its releasing position by movement of said second member through said zone in said other of said directions; and there are other cooperating displacement abutments on the first member and on said other latching element whereby the latter is displaced to its releasing position by movement of said first member through said zone in said one of said directions.

BRIEF DESCRIPTION OF DRAWINGS

In the accompanying drawings, which illustrate what is now regarded as a preferred embodiment of the invention.

DETAILED DESCRIPTION OF PREFERRED EMBODIMENT OF INVENTION

Figure 3:
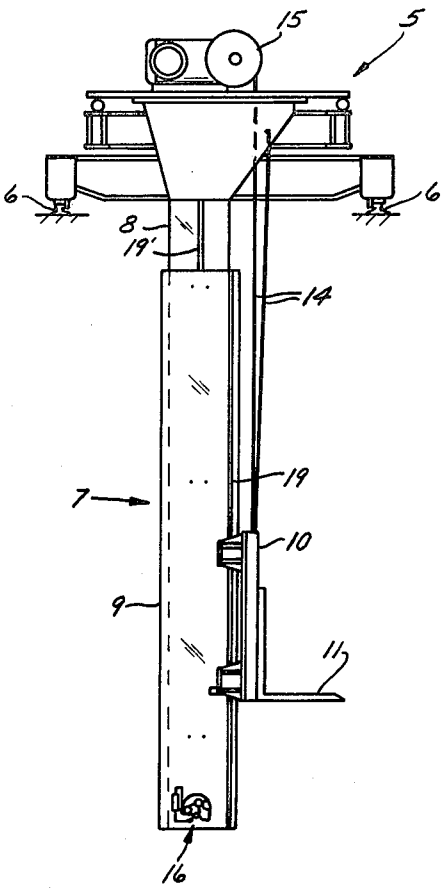
FIG. 3 is a view generally like FIGS. 1 and 2 but showing the load member in the upper part of its range of motion.

In the accompanying drawings, the numeral 5 designates the trolley of a stacker crane, which rides on spaced, parallel overhead rails 6 and from which a mast 7 projects downwardly. The mast 7 comprises an inner mast member 8 and an intermediate mast member 9 which cooperate for guiding a vertically movable load carrying member 10 that is illustrated as comprising a horizontally projecting load engaging fork 11.

At its top the inner mast member 8 has a connection with the trolley 5, and although that connection may provide for rotation of the mast 7 about its axis, so that the fork 11 can project in any desired direction, the inner mast member 8 is not otherwise movable relative to the trolley 5 and can therefore be regarded as relatively fixed. However, the other two members 9 and 10 are movable up and down relative to the inner mast member 8 and to one another. It will be understood that an operator's cab (not shown) may be fixed to the intermediate mast member 9 to move up and down with it.

The inner mast member 8 is of such length that its bottom end is spaced well above the level of a floor 12 over which the crane operates. The intermediate mast member 9, which is in telescoping relation to the inner mast member 8, serves for effectively extending the length of the mast 7, so that the load member 10 can be moved down all the way to the floor 12.

The vertical position of the load member 10 along the mast 7 is controlled by a cable 14 that is connected in a generally conventional arrangement with the load member 10 and with a motor driven windlass or hoist drum 15 on the trolley 5. The vertical position of the intermediate mast member 9 is determined by that of the load member 10, inasmuch as the position of the load member also controls the condition of the latching mechanism 16 of this invention whereby the intermediate mast member 9 is locked either to the load member 10 or to the inner mast member 8.

Figure 1:
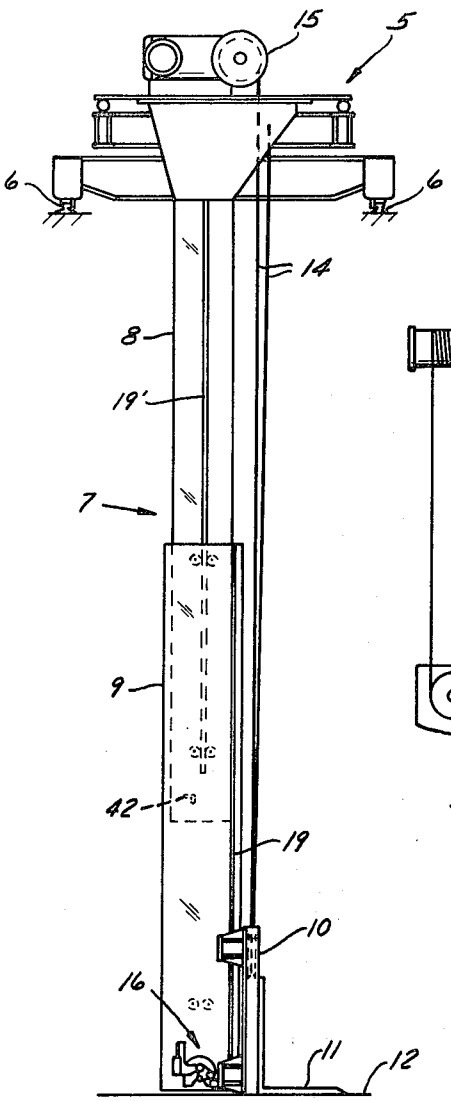
FIG. 1 is a more or less diagrammatic view in elevation of a stacker crane wherein there is incorporated a latching mechanism of the present invention, said stacker crane being shown with its load member near the bottom of its range of motion.

When the load member 10 is in a bottom part of its range of up and down motion (FIG. 1), the latching mechanism 16 is in a condition (FIG. 5) such that the load member 10 is locked to the intermediate mast member 9, at the bottom of the latter, and therefore the intermediate mast member 9 is supported by the load member 10 and moves up and down with it. In this condition of the mechanism 16, the bottom of the mast 7 is never any closer to the floor 12 than the load member 10, to minimize possibilities for collisions between the mast and articles on the floor.

Figure 7:
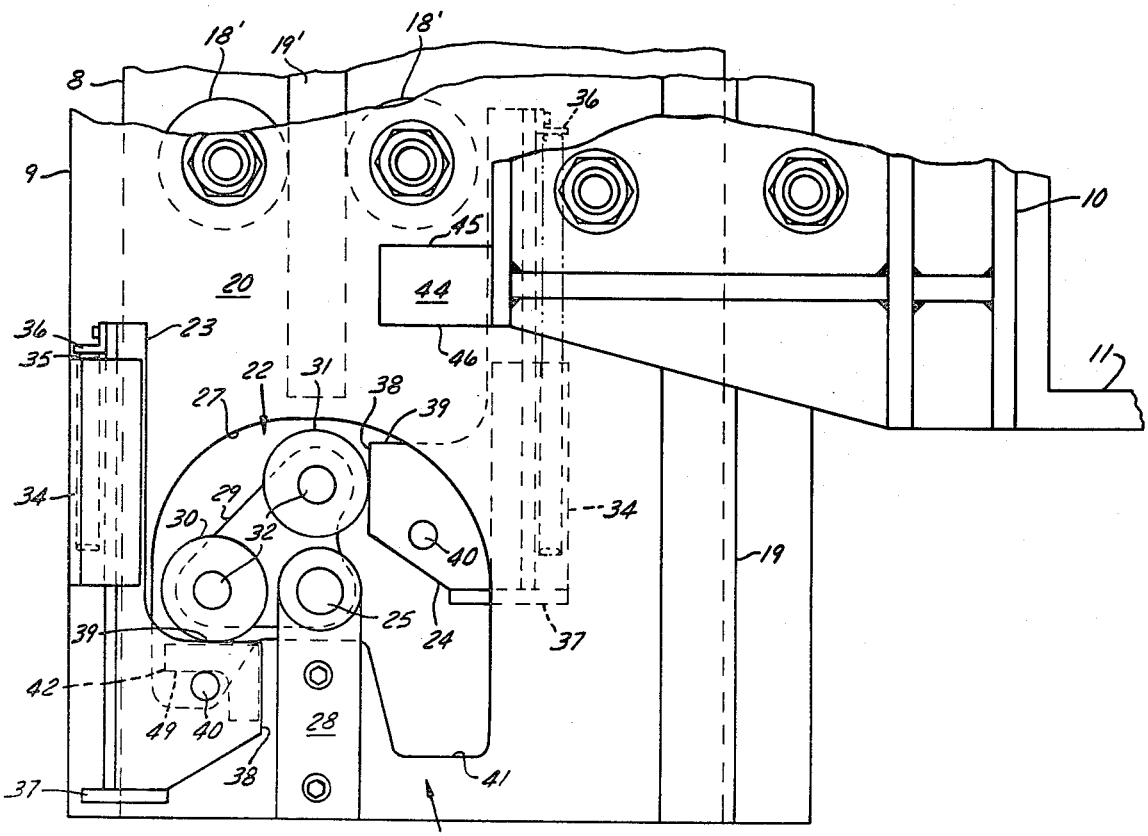
FIG. 7 is a view generally similar to FIGS. 5 and 6 but showing the conditions of the latching mechanism when the load member is in the upper part of its range.

When the load member 10 is in the upper part of its range of motion, as shown in FIG. 3, the latching mechanism 16 is in its alternate condition (FIG. 7). The intermediate mast member 9 is then locked to, and supported by, the inner mast member 8, while the load member 10 moves up and down relative to both of the mast members 8 and 9.

Figure 2:
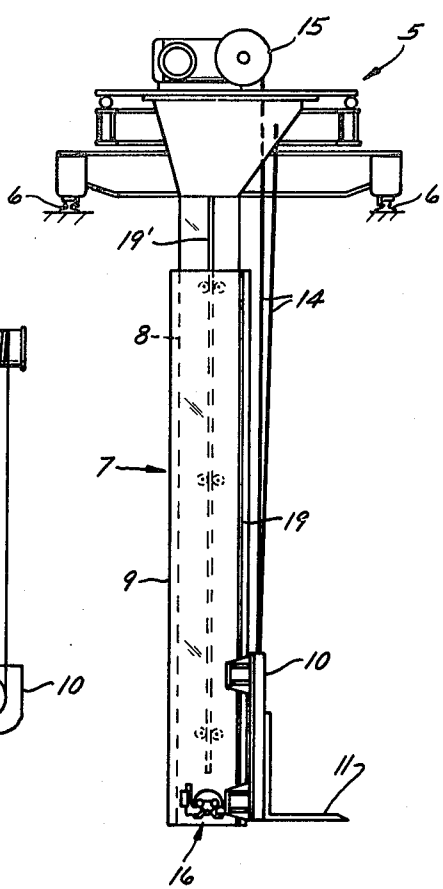
FIG. 2 is a view generally similar to FIG. 1 but showing the load member in a medial zone in its range of motion, wherein transfer of locking takes place.
Figure 4:
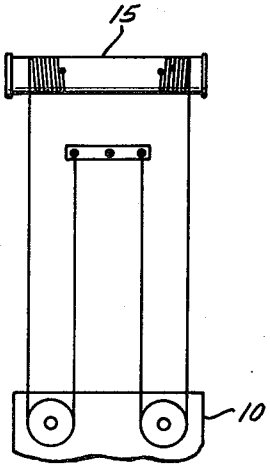
FIG. 4 is a more diagrammatic view showing the lifting connection between the hoisting drum and the load carrying member.
Figure 6:
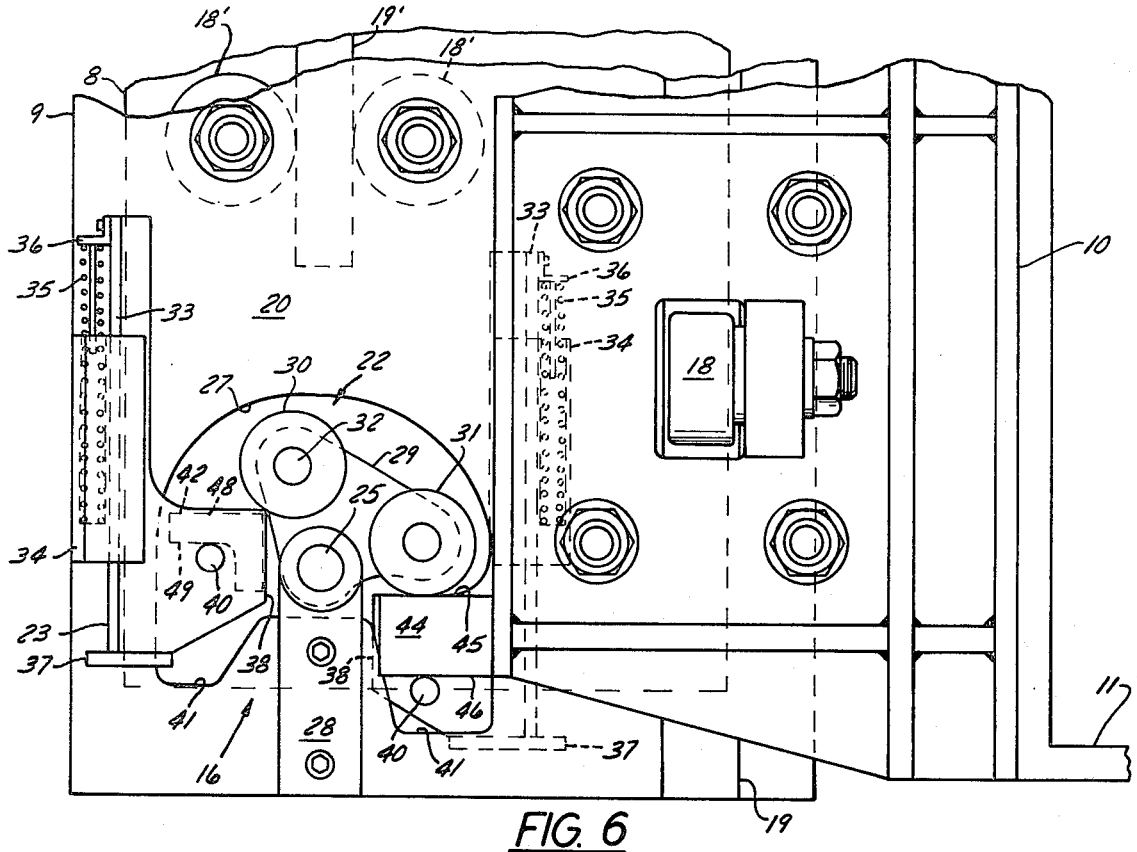
FIG. 6 is a view generally similar to FIG. 5 but showing the latching mechanism at an instant during its transfer, as the load member is passing through the zone at which transfer of locking occurs.

Between these upper and lower parts of its range of motion, when the load member 10 is in about the position shown in FIG. 2, it passes through a vertically short zone in which the latching mechanism 16 automatically undergoes change of condition as shown in FIG. 6. During upward movement of the load member through this zone, the latching mechanism 16 goes from its condition in which the intermediate member 9 is locked to the load member 10 to its condition in which the intermediate member 9 is locked to the inner member 8; during downward movement of the load member 10 through said zone, the latching mechanism undergoes an opposite change of condition.

Figure 9:
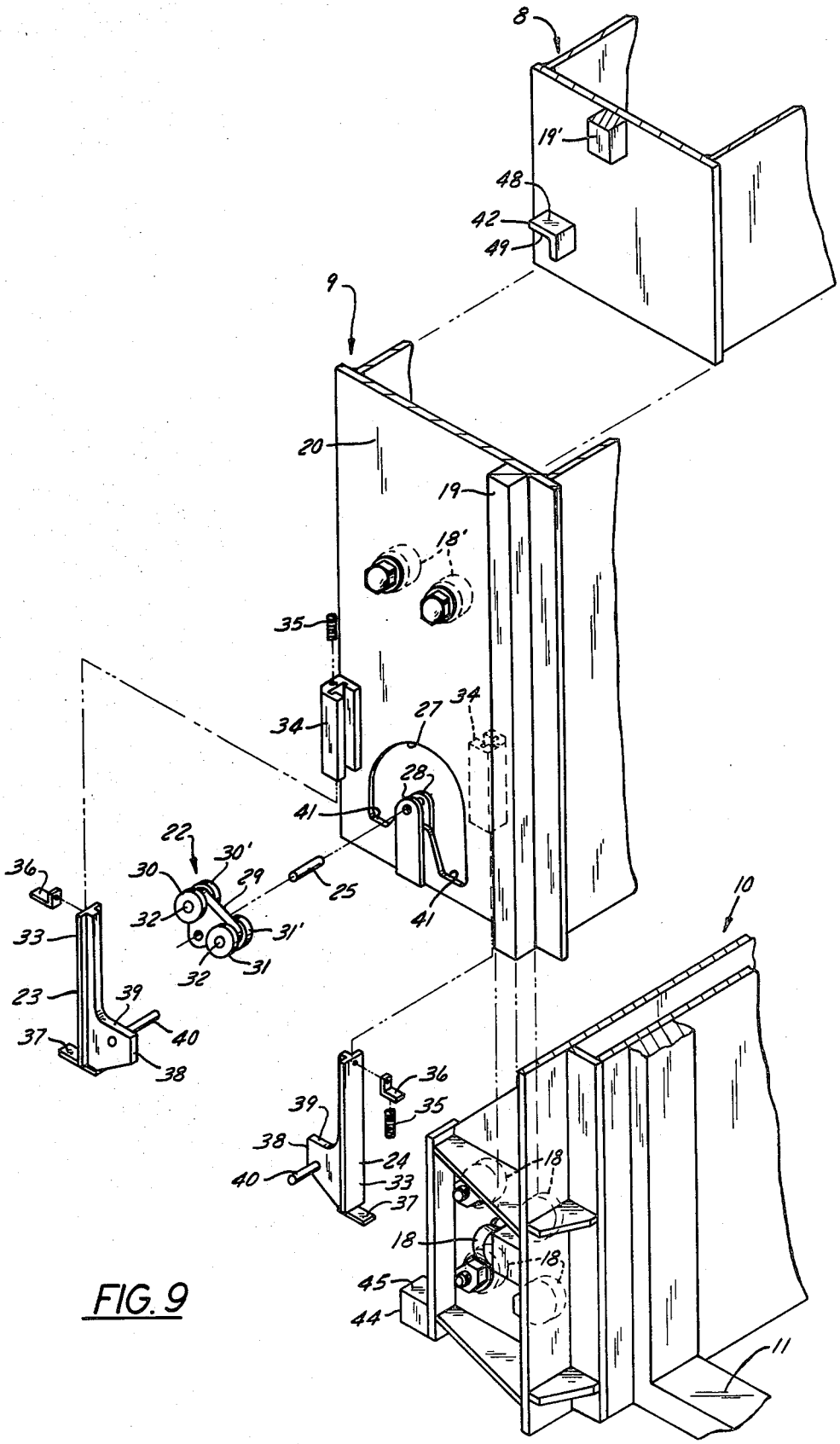
FIG. 9 is an exploded perspective view of the latching mechanism and adjacent portions of the members with which it cooperates.

As shown in FIG. 9, the inner and intermediate mast members 8 and 9 can comprise box beams, with the intermediate member 9 having the larger dimensions in cross-section so that it can fit around the inner member 8 in telescoping relation to it. The load member 10, which partially embraces the intermediate member 9, is confined to vertical motion relative to that member by means of sets of rollers 18 at its opposite sides, cooperating with vertically extending rails 19 that overlie opposite side walls 20 of the intermediate member 9. The intermediate member 9 can be similarly guided for smooth vertical motion along the inner member 8 by conventional rollers 18' on the inside of wall 20 which rides on track surface 19' on inner member 8.

The latching mechanism 16 of this invention is preferably duplicated at the opposite sides of the mast 7. In each case it comprises a toggle element 22, carried by the intermediate mast member 9 for swinging motion relative to it, and a pair of latching elements 23, 24, likewise carried by the intermediate mast member and movable relative to it. The toggle element 22 can swing between a pair of defined locking positions that are respectively illustrated in FIG. 5 and FIG. 7, and the latching elements 23, 24 cooperate with the toggle element to releasably hold it in each of its locking positions and to control its shifting from one locking position to the other at appropriate times.

Figure 8:
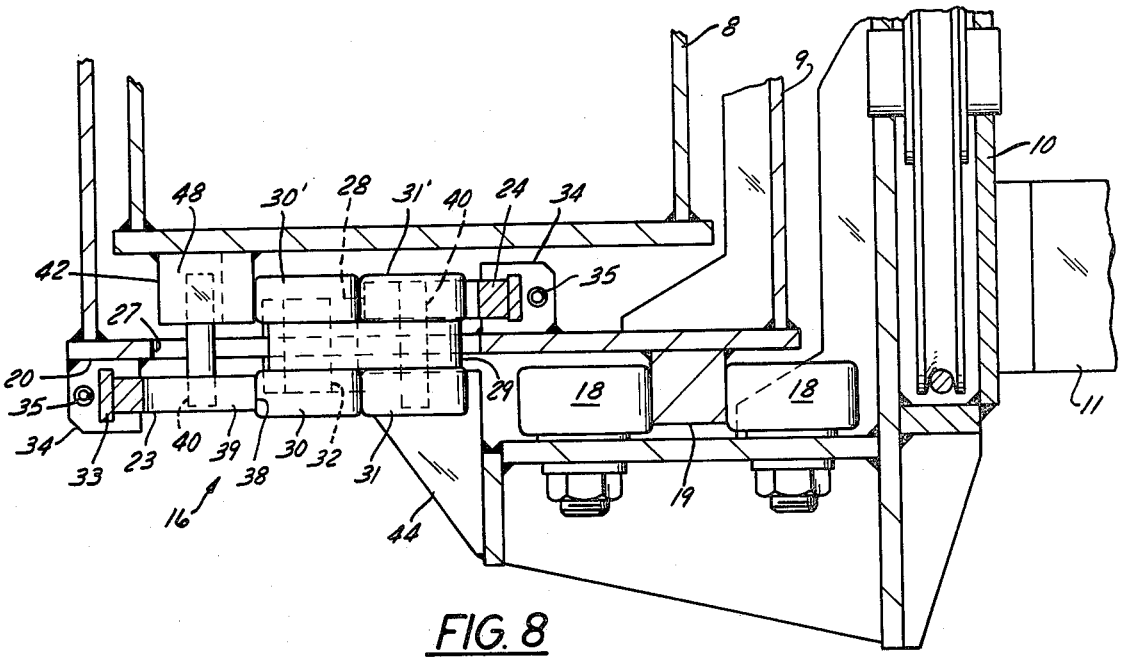
FIG. 8 is a fragmentary view in horizontal section, taken on the plane of the line 8—8 in FIG. 6.

The toggle element 22 comprises a substantially triangular body 29 that carries two pairs 30, 31 of freely rotatable rollers. The body 29 is connected with the intermediate mast member 9 by means of a pin 25 that extends normal to the side wall 20 of that mast member, and the toggle element swings about that pin in an arcuate cutout 27 in said side wall. The pin 25 is supported by a pair of strap-like parallel posts 28 which overlie opposite faces of the side wall 20 and project up beyond the edge of the cutout 27, and it extends through the triangular body 29 near one of its corners. Shafts 32 that journal the respective roller pairs 30, 31 extend through the body 29 near each of its other two corners, parallel to the pivot pin 25. The two rollers 30, 30' and 31, 31' of each roller pair overlie opposite faces of the triangular body 29 and thus project beyond the respective faces of the intermediate member side wall 20, as best seen in FIG. 8.

Each of the latching elements 23, 24 is mounted on the side wall 20 for limited movement relative to it in the directions of relative movement of the mast members 9, 10—up and down in this case. The latching elements 23, 24 are at opposite sides of the toggle element 22, and, as here shown, the left-hand latching element 23 overlies the outer surface of the side wall 20 to cooperate with the toggle element roller 30, while the right-hand latching element 24 overlies the inner surface of that side wall 20 to cooperate with the toggle element roller 31'.

The respective latching elements 23, 24 are confined to translatory vertical motion relative to the intermediate mast member 9 by a pair of vertically extending channel-like guide members 34, one for each latching element, fixed on the side wall 20 of said mast member 9 at opposite sides of the toggle element 22 and each having a groove of substantially T-shaped cross-section that opens towards the toggle element. Each latching element 23, 24 has a relatively long back portion 33 of corresponding T-shaped cross-section that is received in the groove in its guide member 34. The body of each latching element, which is engaged by the toggle element 22, defines a vertical abutment surface 38 and an upwardly facing horizontal abutment surface 39.

Each latching element 23, 24 is biased upwardly to a latching or toggle confining position, as by means of a coiled expansion spring 35 that reacts between a laterally projecting lug 36 on the top of the latching element and an upwardly facing surface in the guide member 34 for that latching element. At the bottom of each latching element is another laterally projecting lug 37 which is engageable against the underside of its guide member 34 to define the latching position towards which the latching member is biased.

Figure 5:
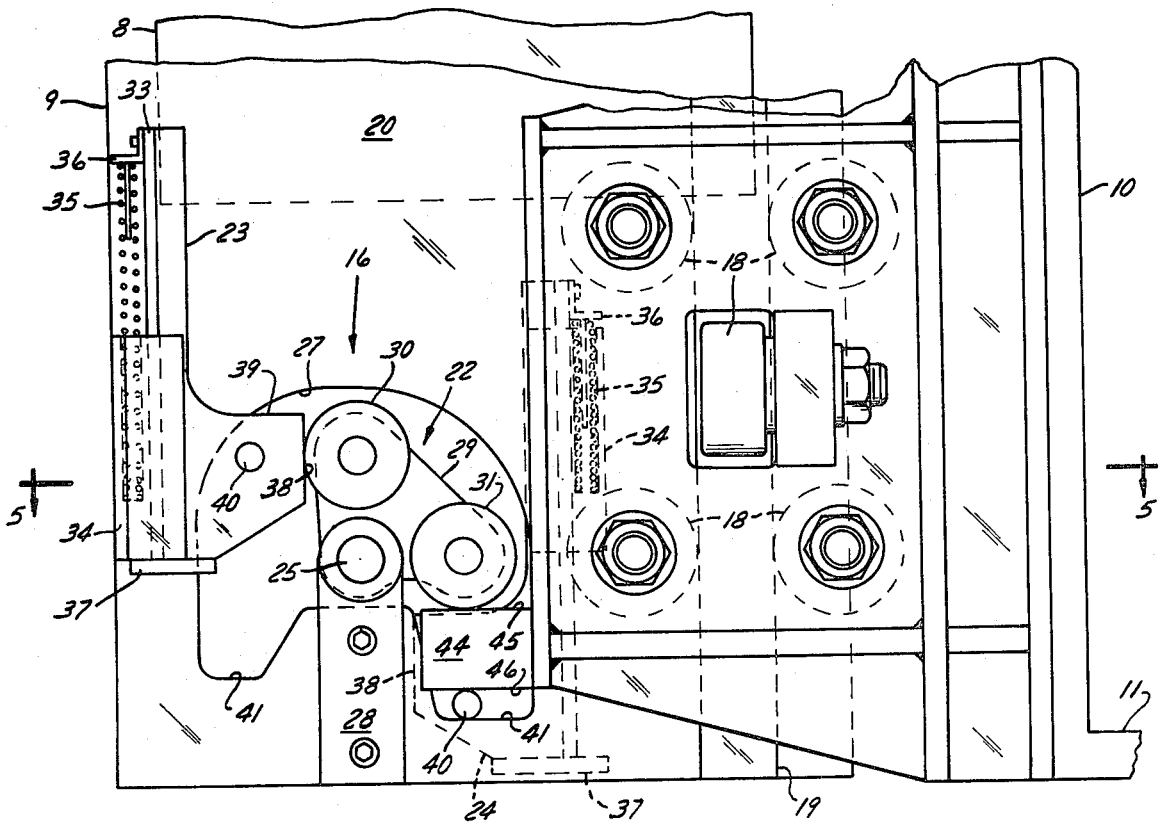
FIG. 5 is a detail view in side elevation, on a larger scale, showing the condition of the latching mechanism of this invention when the load member is in the lower part of its range of travel.

In FIG. 5 the left-hand latching element 23 is shown in its latching position, wherein its vertical abutment surface 38 engages the roller 30 of the toggle element 22 to confine the toggle element in its right-hand locking position. For either latching element 23, 24 to occupy its latching position, the other latching element 24, 23 must be out of its latching position, and therefore FIG. 5 shows the right-hand latching element 24 in its releasing position, with its vertical abutment surface 38 below the roller 31' of the toggle element, and with that roller overlying its horizontal abutment surface 39. In FIG. 7, wherein the toggle element 22 is shown in its left-hand locking position, the latching element 24 is in its latching position and the latching element 23 is in its releasing position.

Fixed to each latching element 23, 24 is a post-like dog 40 that projects through the cutout 27. In each case the dog 40 can engage a lower edge portion 41 of the arcuate cutout 27, to define a releasing position of the latching element 23, 24, although in stacker crane masts such engagement will usually not be essential and therefore the location of the lowermost edge portions 41 of the cutout will not be critical. The dog 40 on each latching element also comprises a part of the means by which the latching element is moved against its bias from its latching position to its releasing position. Specifically, for such actuation, the dog 40 on the left-hand latching element 23 cooperates with a horizontally extending ledge 42 that is fixed on the inner mast member 8, and the dog 40 on the right-hand latching element 24 cooperates with a generally similar ledge 44 on the load member 10. Each of the ledges 42, 44 also cooperates with the toggle element 22 to lock the intermediate mast member 9 to the member 8 or 10 on which that ledge is fixed.

When the load carrying member 10 is in the lower part of its range of movement, the toggle element 22 is in its right-hand locking position shown in FIG. 5, wherein the roller 31 of the toggle element rests on an upper horizontal surface 45 of the ledge 44 on the member 10. Thus, as long as the toggle element 22 remains confined in its FIG. 5 position, the load member 10 supports the intermediate mast member 9. Furthermore, the load member 10 can then be prevented from moving downward relative to the intermediate member 9 if, as shown, the under surface 46 of the ledge 44 rests on the dog 40 of the latching member 23, while said dog, in turn, engages the lower edge portion 41 of the cutout 27. Although the right-hand latching element 24 is biased away from the releasing position in which it is shown in FIG. 5, it cannot move out of that position as long as the toggle element 22 remains in its right-hand locking position, in which it is confined by the left-hand latching element 23.

When the load member 10 is in the upper portion of its range of motion, the toggle element 22 is in its left-hand locking position shown in FIG. 7, with the right-hand latching element 24 in its latching position and the other latching element 23 in its releasing position. Under these conditions, the roller 31' on the toggle element is engaged by the vertical toggle confining surface 38 on the right-hand latching element 24, and the roller 30 overlies the upwardly facing horizontal surface 39 on the other latching element 23. At the same time, the axially inner roller 30' of the left-hand toggle element roller pair engages an upwardly facing abutment surface 48 on the ledge 42 that is fixed to the inner mast member 8, to lock the intermediate member 9 against downward movement relative to the inner mast member. Again, the intermediate mast member 9 can be locked against upward movement relative to the inner member 8 if, in the releasing position of the latching element 23, its dog 40 is confined between an undersurface 49 on the ledge 42 and a lower edge portion 41 of the cutout 27.

Although the two latching elements 23, 24 cannot occupy their latching positions simultaneously, there is a brief interval during flip-over of the toggle element 22 from one to the other of its locking positions when both latching elements are out of their latching positions. During that transient condition, which occurs as the load member 10 moves through a particular zone in its range of motion, and which is illustrated in FIG. 6, the toggle element 22 is engaged with both of the ledges 42 and 44, so that the intermediate mast member 9 is supported by both the inner mast member 8 and the load member 9 and cannot fall. Assume first that the load member 10 has been in the lower portion of its range of motion (FIG. 1) and has therefore been locked to the intermediate mast member 9, as shown in FIG. 5; and that it now moves up into the zone (FIG. 2) at which transfer of locking takes place. As the intermediate member 9 moves up into that zone, the dog 40 on the left-hand latching member 23 engages the undersurface 49 of the ledge 42 on the inner mast member 8. As the intermediate member 9 continues its upward movement, such engagement of the abutments 40 and 42 prevents the latching element 23 from rising with the intermediate mast member 9, which is to say that, relative to the intermediate member 9, the latching element 23 will be actuated downward towards its releasing position, against the bias of its spring 35. At the same time, the toggle element 22 will be urged out of its right-hand locked position shown in FIG. 5, and towards its opposite (FIG. 7) locked position, by a force couple comprising the lifting force on the load member 9, exerted upon the roller 31 by the abutment surface 45, and the weight of the intermediate member 9, acting through the toggle element pivot pin 25. The toggle element 22 also tends to be urged towards its opposite locking position by the biasing force exerted upon the roller 31' by the latching element 24 as its spring 35 urges it towards its latching position.

Once the latching element 23 has been moved fully to its releasing position, the other latching element 24 can move all the way to its retaining position, as can be seen from a comparison of FIGS. 6 and 7; and the load carrying member 10 can move up and down through the upper portion of its range of motion while the intermediate mast member 9 remains locked to the inner mast member 8.

As the load carrying member 10 moves downward into the zone at which flip-over of the toggle element 22 occurs, the bottom abutment surface 46 of the ledge 44 on the load carrying member engages the dog 40 on the latching element 24. As the load carrying member continues its downward movement, the latching element 24 is brought to its releasing position, allowing the toggle element 22 to swing away from its FIG. 7 locked position while the latching element 23 moves to its retaining position under the bias of its spring 35.

From the foregoing description taken with the accompanying drawing it will be seen that this invention provides an automatic latching mechanism which is particularly well suited for a mast of a stacker crane or the like, and wherein actuation of relatively moving parts takes place without any sliding engagement between camming surfaces, all movements of such parts being effected in consequence of a squarely abutting pushing engagement which greatly simplifies accurate assembly of the cooperating parts and minimizes wear on them.

What is claimed as the invention is:

1. In apparatus having first and second members which are movable in a pair of opposite directions relative to one another and to a third member, said first member having a range of motion in said directions that extends to opposite sides of a medial zone, and said second member being biased in the direction towards one side of said zone, automatic connection means whereby said second member is constrained to move with said first member when the latter is at said one side of said medial zone and whereby said second member is confined against motion relative to said third member when the first member is at the other side of said zone, said automatic connection means comprising:

A. a toggle element carried by said second member and confined to swinging motion relative thereto between a pair of locking positions;

B. a pair of latching elements carried by said second member, one at each side of said toggle element, each of said latching elements being movable relative to said second member (1) substantially in said one direction to a releasing position and (2) substantially in the other of said directions to a latching position towards which the latching element is biased, at which it confines the toggle element in one of its locking positions, but to which the latching element can move only when the other latching element is in its releasing position;

C. means defining a pair of locking abutments, each having a surface facing substantially in said other of said directions, (1) one on said first member having its said surface engageable by said toggle element when one of said latching elements is in its releasing position, and (2) the other on said third member having its said surface engageable by said toggle element when the other of said latching elements is in its releasing position;

D. cooperating displacement abutments on the first member and on said one latching element whereby the latter is displaced to its releasing position by movement of said first member through said zone in said one direction; and E. other cooperating displacement abutments on the third member and on said other latching element whereby the latter is displaced to its releasing position by movement of the second member through said zone in said other direction.

2. The automatic connection means of claim 1 wherein said means defining a pair of locking abutments comprises a ledge on each of said first member and said third member, each such ledge having, in addition to said surface facing substantially in said other of said directions, an opposite surface facing in said one direction; and wherein said displacement abutments comprise a dog on each of said latching elements, engageable against said opposite surface of a ledge.

3. The automatic connection means of claim 2 wherein said second member comprises a wall having opposite inner and outer faces, wherein said latching elements respectively overlie the opposite faces on said wall, and wherein said dog on each latching element projects through a cutout in said wall and engages an edge portion of the cutout to define the releasing position of the latching element.

4. In apparatus comprising first and second members which are slidable in a pair of opposite directions relative to one another and to a third member and connection means of the type comprising a toggle element carried by said second member and confined to swinging motion relative thereto that carries said toggle element to a first locking position engaging an abutment on said first member, for constraining the second member to slide with the first member, and to an opposite locking position engaging an abutment on the third member, for confining the second member against sliding relative to the third member, automatic toggle control means for holding the toggle element in its said first locking position when the first member is at one side of a medial zone in its range of sliding motion, for holding the toggle element in its said opposite locking position when the first member is at the other side of said medial zone, and for releasing the toggle element to swing between its said locking positions as the first member moves through said zone, said toggle control means comprising:

A. a pair of latching elements, one at each side of said toggle element, each carried by said second member and shiftable relative to it in said directions to and from a latching position, (1) one of said latching elements, when in its latching position, confining the toggle element in its first locking position, (2) the other latching element, when it its latching position, confining the toggle element in its opposite locking position, and (3) said latching elements so cooperating with the toggle element that each latching element can shift to its latching position only when the other latching element is out of its latching position;

B. cooperating abutment means on said one latching element and on the third member for shifting said one latching element out of its latching position in consequence of movement of said second member through said zone in the direction from said one side towards said other side thereof; and C. other cooperating abutment means on said other latching element and on said first member for shifting said other latching element out of its latching position in consequence of movement of said first member through said zone in the direction from said other side toward said one side thereof.

5. The toggle control means of claim 4, further characterized by:

D. means yieldingly biasing each of said latching elements in the direction towards its latching position.

6. In apparatus comprising first and second members which are slidable in a pair of opposite directions relative to one another and to a third member, connection means of the type comprising a toggle element carried by said second member and confined to swinging motion relative thereto that carries said toggle element to a first locking position in which it can constrain the first member to slide with the second member and to an opposite locking position in which it can confine the second member against sliding relative to the third member, said connection means being characterized by:

A. a first ledge fixed on said first member and defining (1) a first locking surface which faces substantially in one of said directions and which is engaged by said toggle element when the same is in its first locking position and (2) a first displacement surface which faces substantially in the other of said directions;

B. a second ledge fixed on said third member and defining (1) a second locking surface which faces substantially in said one direction and which is engaged by said toggle element when the same is in its said opposite locking position and (2) a second displacement surface facing substantially in said other direction;

C. a pair of latching elements, each carried by said second member for shifting relative thereto substantially in said one direction to a latching position and substantially in said other direction out of said latching position, said latching elements being at opposite sides of the toggle element and (1) one of said latching elements, when in its latching position, confining the toggle element in its first locking position and (2) the other of said latching elements, when in its latching position, confining the toggle element in its opposite locking position, said latching elements so cooperating with the toggle element that each latching element can shift to its latching position only when the other is out of its latching position;

D. a dog on said one latching element, engageable with said second displacement surface to effect shifting of that latching element out of its latching position in consequence of movement of said second member in said one direction through a predetermined zone; and E. another dog on said other latching element, engageable with said first displacement surface to effect shifting of said other latching element out of its latching position in consequence of movement of said first member in the opposite direction through a predetermined zone.

7. In apparatus comprising first and second members which are slidable in a pair of opposite directions relative to one another and to a third member, and connection means of the type comprising a toggle element carried by said second member and confined to swinging motion relative thereto whereby said toggle element is carried to each of a pair of locking positions, in one of which the toggle element engages a locking abutment on the first member to constrain said second member to slide with the first member, and in the other of which the toggle element engages a locking abutment on the third member to confine said second member against sliding relative to the third member, automatically operating means for controlling swinging of the toggle element in accordance with the position of sliding motion of said first member relative to said third member, said automatically operating means being characterized by:

A. a pair of latching elements carried by said second member, said latching elements (1) being spaced to opposite sides of an axis about which said toggle element swings and (2) each being movable relative to said second member in substantially said directions to and from a latching position in which the latching element confines the toggle element in one of its locking positions, so that each latching element can move to its latching position only when the other latching element is out of its latching position;

B. cooperating displacement abutments on one of said latching elements and the first member whereby said one latching element is moved out of its latching position in consequence of relative movement between the first member and the second member; and C. other cooperating displacement abutments on the other of said latching elements and the third member whereby said other latching element is moved out of its latching position in consequence of relative movement between the third member and the second member.

8. The apparatus of claim 7, further characterized by: each of said latching elements being biased towards its latching position.

9. The apparatus of claim 7, wherein said second member is biased in one of said directions relative to the first member and the third member, and wherein said locking abutments face substantially in the opposite direction so that the toggle element tends to swing away from each of its locking positions.

10. In a stacker crane of the type comprising an elevated horizontally movable trolley having hoisting means thereon, a load member beneath said trolley supported by said hoisting means for a range of vertical motion, and mast means for guiding the load member in its vertical motion, said mast means comprising an inner member projecting down from said trolley in vertically fixed relation thereto and an intermediate member movable vertically in telescoping relation to said inner member, automatic latching means for locking the intermediate member to the load member when the latter is in a lower part of its said range of motion and for locking the intermediate member to the inner member when the load member is in an upper part of said range, said automatic latching means comprising:

A. a pair of ledges, each having an upwardly facing locking surface and a downwardly facing displacement surface, (1) one of said ledges being fixed on said load member and (2) the other being fixed on said inner member;

B. a toggle element carried by said intermediate member for swinging motion relative thereto between a pair of locking positions, in each of which the toggle element engages the locking surface on one of said ledges;

C. a pair of latching elements carried by said intermediate member at opposite sides of said toggle element, each latching element being displaceable relative to said intermediate member upwardly to a latching position and downwardly to a releasing position (1) one of said latching elements, when in its latching position, confining the toggle element to its locking position of engagement with the locking surface on said one ledge, and (2) the other latching element, when in its latching position, confining the toggle element to its locking position of engagement with the locking surface on said other ledge;

D. a dog on said other latching element engageable with the displacement surface on said one ledge to effect displacement of said other latching element out of its latching position in consequence of movement of said load member from said lower part of its range to said upper part thereof; and E. a dog on said one latching element engageable with the displacement surface on said other ledge to effect displacement of said one latching element out of its latching position in consequence of movement of said load member from said upper part of its range to said lower part thereof.

11. The stacker crane latching means of claim 10, further characterized by:

F. spring means reacting between said intermediate member and each of said latching elements to bias each latching element upwardly to its latching position.

* * * * *